United States Patent [19]

Ziegler

[11] Patent Number: 4,750,218

[45] Date of Patent: Jun. 14, 1988

[54] REVERSIBLE GLOVE CONSTRUCTION

[75] Inventor: Guenther Ziegler, North Attleboro, Mass.

[73] Assignee: Azon Corporation, North Attleboro, Mass.

[21] Appl. No.: 946,709

[22] Filed: Dec. 29, 1986

[51] Int. Cl.[4] ..... A41D 19/00

[52] U.S. Cl. ..... 2/159; 2/161 R; 2/162; 2/167

[58] Field of Search ..... 2/159, 161, 162, 161 R

[56] References Cited

U.S. PATENT DOCUMENTS 1,106,708 8/1914 Hazard ..... 2/159

4,493,865 1/1985 Kuhlmann ..... 2/161 R

*Primary Examiner*—Louis K. Rimrodt

*Attorney, Agent, or Firm*—Salter & Michaelson

[57] ABSTRACT

A reversible glove construction includes a cuff portion including a pair of connected side-by-side cuff strips and a reversible glove portion which is secured to the cuff portion between the cuff strips. The glove portion is preferably made of a protective wire mesh sheet material; and because the glove portion is secured to the cuff portion between the cuff strips, the glove is securable on either hand of a wearer in a position wherein one of the cuff strips overlies the open end portion of the glove and the other cuff strip overlies the adjacent portion of the wearer's wrist.

6 Claims, 1 Drawing Sheet

REVERSIBLE GLOVE CONSTRUCTION

BACKGROUND AND SUMMARY OF THE INVENTION

The instant invention relates to safety apparatus and more particularly to a reversible glove constuction which can be effectively embodied as a safety glove of the type used by meat cutters.

It has been found that it can be highly desirable for persons involved in meat cutting operations to wear protective gloves in order to avoid being inadvertently cut by knives or other sharp instruments which are used to cut meats. In this connection, gloves made of flexible open wire mesh materials have been heretofore available for a number of years and have been found to be effective for preventing most wounds which are caused by inadvertent contact with various blades, knives, and sharp instruments. In most cases, however, it has only been necessary for a meat cutter to wear a glove of this type on one hand, since the other hand has normally been used for holding the knife or other instrument which is used during the meat cutting operation, and therefore the other hand has been less likely to be wounded. However, one of the drawbacks of most of the heretofore available protective gloves of this type has been that they have not been reversible, and hence it has been necessary for them to be made in different right- and left-handed embodiments for use by left- and right-handed meat cutters, respectively. As a reult, most of, the heretofore available gloves have not been universally adaptable for use by all meat cutters, and since gloves of this type have generally been relatively expensive, this has been a disadvantage from both a practical standpoint and an economic standpoint.

The U.S. Pat. Nos. 1,106,708 to Hazard; 2,737,663; Harris 2,862,208Castro; 3,739,400; Colehower 4,004,295; Byrnes, Sr. 4,193,135; Rhee 4,388,733; Anstett and 4,471,495 Kruse et al disclose a variety of glove constructions which represent the closest prior art to the subject invention of which the applicant is aware. However, since these references fail to effectively solve the problem of providing a simple and effective reversible safety glove construction, they are believed to be of only general interest with respect to the subject invention.

The instant invention provides a highly effective reversible glove construction which is adapted to be embodied as a safety glove for use in protecting a hand of a meat cutter during a meat cutting operation. More specifically, the glove construction of the instant invention comprises a reversible glove portion made of a flexible sheet material and a cuff portion which is secured to the open end portion of the glove portion and includes a pair of elongated, connected, side-by-side cuff strips. The cuff portion is constructed so that it is alternatively securable in encircling relation around either wrist of a wearer, and the open end portion of the glove portion is secured to the cuff portion in the area between the elongated cuff strips. As a result, the glove is securable on either hand of a wearer in a position wherein the cuff portion is secured in encirculing relation around the adjacent wrist and wherein one of the cuff strips overlies the open end portion of the glove portion and the other cuff strip is positioned immediately beyond the open end portion of the glove portion on the adjacent wrist. In the preferred embodiment of the glove construction, the glove portion is constructed of a flexible wire mesh sheet material, and the cuff strips are constructed so that they are independently securable in encircling relation around either wrist of a wearer. Further, the glove portion is preferably formed with a longitudinally extending slit therein which extends inwardly a distance from the open end of the glove portion, and the cuff portion is preferably secured to the glove portions so that the ends of the cuff portion are positioned adjacent opposite side edges of the slit to enable the slit and the cuff portion to be opened for more easily receiving a hand in the glove portion. Still further, the glove portion and the cuff portion are preferably dimensioned so that when the glove portion is received on a hand of a wearer, the portions of the glove portion which are located adjacent the slit overlap each other to assure that the hand is completely covered and protected by the wire mesh material.

Accordingly, it is seen that the instant invention provides an effective glove construction which is adapted to be embodied as a wire mesh safety glove and which is effectively reversible to enable it to be alternatively worn on the left hand or on the right hand. Specifically, the cuff portion of the glove construction and the manner in which the glove portion is attached to the cuff portion make the glove construction readily reversible to enable it to be alternatively worn on either the left hand or the right hand.

As a result of the above, it is a primary object of the instant invention to provide an effective reversible glove construction which is adapted to be embodied as a wire mesh safety glove.

Another object of the instant invention is to provide an effective reversible glove construction having a glove portion and having a cuff portion which includes a pair of elongated side-by-side cuff strips wherein the glove portions is secured to the cuff portion between the cuff strips.

An even further object of the instant invention is to provide a reversible safety glove for meat cutters.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention.

DESCRIPTION OF THE INVENTION

Figure 1:
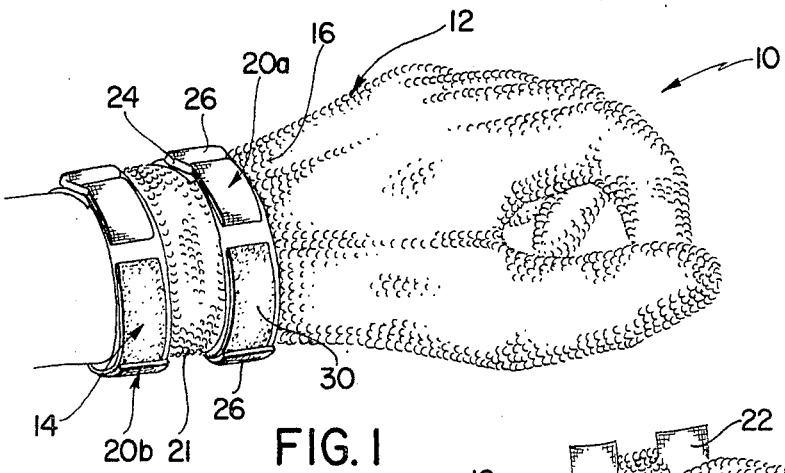
FIG. 1 is a perspective view of the safety glove of the instant invention as it is worn on a left hand of a wearer.
Figure 2:
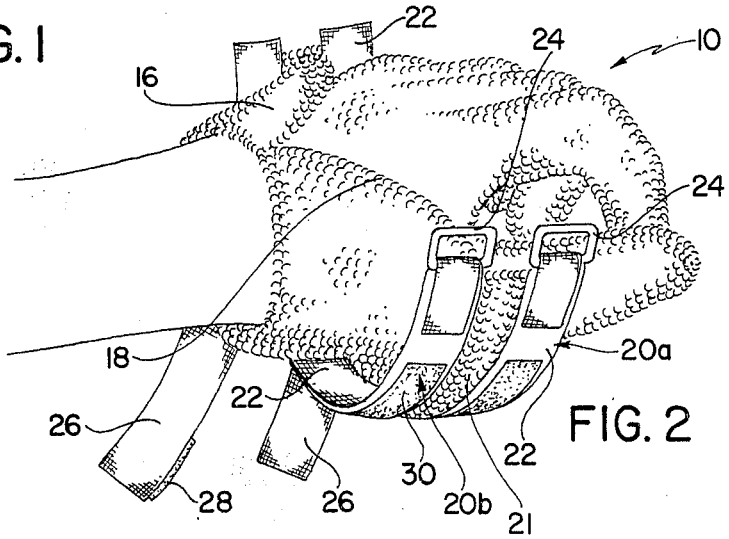
FIG. 2 is a perspective view illustrating the removal of the glove from the left hand and the reversal of the glove.
Figure 3:
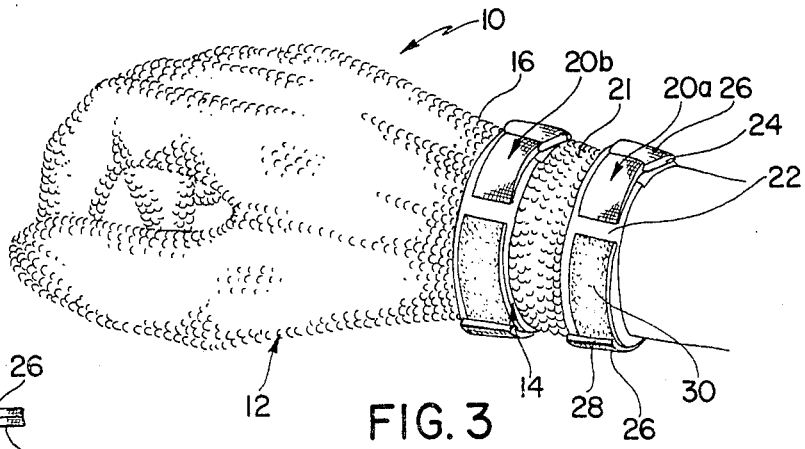
FIG. 3 is a perspective view of the glove as it is worn on a right hand of a wearer.

Referring now to the drawing, the reversible glove construction of the instant invention is illustrated and generally indicated at 10 in FIGS. 1 through 3. The glove construction 10 comprises a glove portion generally indicated at 12 and a cuff portion generally indicated at 14, and it is reversble to enable it to be alternatively worn on a left hand, as illustrated in FIGS. 1 and 2 or on a right hand, as illustrated in FIG. 3.

The glove portion 12 is preferably made of a suitable flexible wire mesh sheet material comprising a large number of interconnected stainless-steel links or rings of relatively small diameter, and it is dimensioned and configured so that it is receivable on a hand of a wearer in a manner similar to a conventional glove. The glove portion 12 is, however, constructed so that it is reversible to enable it to be alternatively worn on either the right hand of a wearer or the left hand of the wearer. As will be seen from FIG. 2, the glove portion 12 includes an open end portion 16 which is positioned adjacent to and connected to the cuff portion 14, and a slit 18 extends a distance longitudinally inwardly through the open end portion 16 to enable it to be expanded for more easily receiving a hand in the glove portion 12. The open end portion 16 is preferably dimensioned so that when the glove portion 12 is received on a hand, the areas of the open end portion 16 which are adjacent the slit 18 are receivable in overlapping relation with each other in order to avoid leaving exposed or unprotected areas on the hand.

The cuff portion 14 is attached to the open terminal end of the open end portion 16 as illustrated, and it comprises first and second elongated cuff strips **20*a* and 20*b* which are intereconnected in adjacent, substantially side-by-side relation with a wire mesh connector portion 21. The cuff strips 20*a* and 20*b* are preferably independently securable in encircling relation on a wrist of a wearer, and they preferably each comprise a flexible fabric base strip 22, a buckle 24, an end strip 26 having a patch 28 of a hook-and-loop type fastening element, such as Velcro (Velcro USA TM), thereon, and a patch 30 of a hook-and-loop type fastening element of complementary configuration on the other side of the base strip 22 thereof. Accordingly, each of the cuff strips 20*a* and 20*b* is securable in encircling relation on a wrist by passing the end strip 26 thereof through the loop 24 thereof and then fastening the patch 28 on the end strip 26 thereof to the patch 30 on the base strip 22 thereof in the manner illustrated in FIGS. 1 and 3**.

Figure 4:
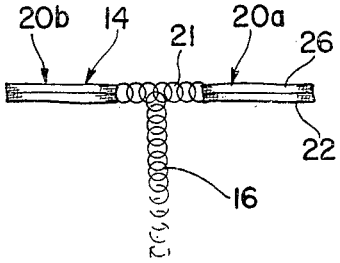
FIG. 4 is a sectional view illustrating the attachment of the glove portion to the cuff portion.

As illustrated in FIG. 4, the open end portion 16 of the glove portion 12 is secured to the cuff portion 14 between the cuff strips **20*a* and 20*b* thereof, and more specifically, it is secured to the connector portion 21 so that the cuff strips 20*a* and 20*b* are disposed on opposite sides of the open end portion 16. Accordingly, as illustrated in FIG. 1, the cuff portion 14 is positionable so that the first cuff strip 20*a* thereof overlies the adjacent portion of the open end portion 16 and so that the second cuff strip 20*b* thereof is positioned immediately beyond the open end portion 16 and is receivable in overlaying encircling relation on a wrist of a wearer. Alternatively, as illustrated in FIG. 3, when the glove portion 12 is turned inside-out or reversed, the cuff portion 14 is positionable so that the second cuff strip 20*b* thereof overlies the open end portion 16 and the first cuff strip 20*a* is positioned immediately beyond the open end portion 16 and is receivable in overlying, encircling relation on a wrist of a wearer. As a result, it is seen that the cuff portion 14 is reversible to enable it to be utilized for securing the glove portion 12** on either hand of a wearer.

It is seen, therefore, that the instant invention provides a highly effective glove construction which is readily reversible to enable it to be worn on either hand. Specifically, because of the manner in which the cuff portion 14 is secured to the glove portion 12, the cuff portion 14 can be effectively utilized for securing the glove portion 12 on either hand. Accordingly, the glove 10 can be manufactured in a single configuration for use on either the left hand or the right hand, and a single glove can be worn by many different meat cutters at different times. Hence it is seen that the instant invention effectively overcomes the disadvantages of the heretofore available glove constructions and that it represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A reversible glove construction comprising a glove portion made of a flexible sheet material, said glove portion being reversible and being adapted to be received on either hand of said wearer, and a cuff portion including a pair of elongated connected substantially side-by-side cuff strips, said cuff portion being alternatively securable in encircling relation around either wrist of said wearer, the open end portion of said glove portion being secured to said cuff portion between said cuff strips so that said cuff strips are disposed on opposite sides of said end portion whereby said glove is alternatively securable on either hand of said wearer in a position wherein said cuff portion is secured in encircling relation around the adjacent wrist and one of said cuff strips overlies the open end portion of said glove portion and the other of said cuff strips is positioned immediately beyond said open end portion on said adjacent wrist.

2. In the reversible glove construction of claim 1, said cuff strips each being independently securable in encircling relation around a wrist of said wearer.

3. In the reversible glove construction of claim 1, said sheet material further characterized as a protective sheet material.

4. In the reversible glove construction of claim 1, said sheet material further characterized as a wire mesh.

5. In the glove construction of claim 4, said glove portion and said cuff portion being dimensioned so that the portions of said glove portion which are adjacent said slit overlap each other when said glove construction is received and secured on a hand of a wearer.

6. In the glove construction of claim 1, said glove portion having a longitudinally extending slit therein which extends inwardly from the open end of said glove portion, said cuff portion being secured to said glove portion in a manner which enables said slit to be opened for receiving a hand in said glove portion.

* * * * *